US010483642B2

(12) United States Patent
Wang et al.

(10) Patent No.: US 10,483,642 B2
(45) Date of Patent: Nov. 19, 2019

(54) COMPOSITE RIGHT/LEFT-HANDED TRANSMISSION LINE ANTENNA

(71) Applicant: Huawei Technologies Co., Ltd., Shenzhen (CN)

(72) Inventors: Lei Wang, Shanghai (CN); Meng Hou, Shanghai (CN); Xuefei Zhang, Shenzhen (CN); Jianming Li, Shanghai (CN); Hanyang Wang, Reading (GB)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 218 days.

(21) Appl. No.: 15/508,348

(22) PCT Filed: Sep. 3, 2014

(86) PCT No.: PCT/CN2014/085835

§ 371 (c)(1),
(2) Date: Mar. 2, 2017

(87) PCT Pub. No.: WO2016/033756

PCT Pub. Date: Mar. 10, 2016

(65) Prior Publication Data

US 2017/0288308 A1 Oct. 5, 2017

(51) Int. Cl.

| | |
|---|---|
| ***H01Q 9/42*** | (2006.01) |
| ***H01Q 5/335*** | (2015.01) |
| ***H01Q 1/24*** | (2006.01) |
| ***H01Q 13/10*** | (2006.01) |
| ***H01Q 13/08*** | (2006.01) |

(52) U.S. Cl.
CPC ..... *H01Q 5/335* (2015.01); *H01Q 1/243* (2013.01); *H01Q 9/42* (2013.01); *H01Q 13/08* (2013.01); *H01Q 13/10* (2013.01)

(58) Field of Classification Search
CPC .. H01Q 5/33; H01Q 1/24; H01Q 9/42; H01Q 13/08; H01Q 13/10
USPC ..... 343/702
See application file for complete search history.

(56) References Cited

U.S. PATENT DOCUMENTS

| | | | | |
|---|---|---|---|---|
| 2004/0056730 | A1 | 3/2004 | Toncich et al. | |
| 2009/0033558 | A1* | 2/2009 | Chung | H01Q 13/10 343/700 MS |
| 2009/0140946 | A1 | 6/2009 | Ziolkowski et al. | |

(Continued)

FOREIGN PATENT DOCUMENTS

| | | | |
|---|---|---|---|
| CN | 201222536 | Y | 4/2009 |
| CN | 101447602 | A | 6/2009 |

(Continued)

OTHER PUBLICATIONS

Machine Translation and Abstract of Chinese Publication No. CN103078176, Part 1, May 1, 2013, 13 pages.

(Continued)

*Primary Examiner* — Andrea Lindgren Baltzell
(74) *Attorney, Agent, or Firm* — Conley Rose, P.C.

(57) ABSTRACT

A composite right/left-handed transmission line antenna includes a first radiator, a second radiator, and a capacitive matching circuit, where the first radiator is connected to the second radiator, the connected first radiator and second radiator are of a ring shape, and the matching circuit is connected to a feed-in point of the first radiator or the second radiator.

14 Claims, 6 Drawing Sheets

(56) References Cited

U.S. PATENT DOCUMENTS

| | | | |
|---|---|---|---|
| 2009/0153407 | A1 | 6/2009 | Zhang et al. |
| 2011/0193762 | A1 | 8/2011 | Choi et al. |
| 2011/0199268 | A1 | 8/2011 | Gapski et al. |
| 2012/0056788 | A1 | 3/2012 | Ryou et al. |
| 2012/0127049 | A1 | 5/2012 | Kato |
| 2012/0299785 | A1 | 11/2012 | Bevelacqua |
| 2014/0008437 | A1 | 1/2014 | Wang et al. |
| 2014/0078008 | A1 | 3/2014 | Kang et al. |

FOREIGN PATENT DOCUMENTS

| | | | |
|---|---|---|---|
| CN | 101919112 | A | 12/2010 |
| CN | 102341960 | A | 2/2012 |
| CN | 102771008 | A | 11/2012 |
| CN | 202651351 | U | 1/2013 |
| CN | 202905948 | U | 4/2013 |
| CN | 103078176 | A | 5/2013 |
| CN | 203218446 | U | 9/2013 |
| CN | 203386889 | U | 1/2014 |
| EP | 2528165 | A1 | 11/2012 |
| JP | 2004526379 | A | 8/2004 |
| JP | 2012085250 | A | 4/2012 |
| JP | 2012519448 | A | 8/2012 |
| JP | 2012186803 | A | 9/2012 |
| JP | 2013192073 | A | 9/2013 |
| JP | 2014107746 | A | 6/2014 |
| KR | 20120013721 | A | 2/2012 |
| WO | 2008030021 | A1 | 3/2008 |

OTHER PUBLICATIONS

Machine Translation and Abstract of Chinese Publication No. CN103078176, Part 2, May 1, 2013, 5 pages.
Machine Translation and Abstract of Chinese Publication No. CN201222536, Apr. 15, 2009, 20 pages.
Machine Translation and Abstract of Chinese Publication No. CN202905948, Apr. 24, 2013, 7 pages.
Machine Translation and Abstract of Chinese Publication No. CN203218446, Sep. 25, 2013, 6 pages.
Foreign Communication From a Counterpart Application, European Application No. 14901121.5, dated Jul. 25, 2017, Extended European Search Report, 9 pages.
Foreign Communication Form a Counterpart Application, PCT Application No. PCT/CN2014/085835, English Translation of International Search Report dated May 27, 2015, 2 pages.
Foreign communication Form a Counterpart Application, PCT Application No. PCT/CN2014/085835, English Translation of Written Opinion dated May 27, 2015, 4 pages.
Machine Translation and Abstract of Chinese Publication No. CN203386889, Jan. 8, 2014, 5 pages.
Foreign Communication From a Counterpart Application, European Application No. 14901121.5, European Office Action dated Jun. 4, 2018, 7 pages.
Machine Translation and Abstract of Chinese Publication No. CN101447602, Jun. 3, 2009, 10 pages.
Machine Translation and Abstract of Chinese Publication No. CN102771008, Nov. 7, 2012, 18 pages.
Foreign Communication From a Counterpart Application, Chinese Application No. 201480037112.2, Chinese Notice of Allowance dated Dec. 11, 2018, 4 pages.
Machine Translation and Abstract of Japanese Publication No. JP2013192073, Sep. 26, 2013, 15 pages.
Machine Translation and Abstract of Japanese Publication No. JP2014107746, Jun. 9, 2014, 22 pages.
Foreign Communication From a Counterpart Application, Japanese Application No. 2017-512340, Japanese Notice of Allowance dated Mar. 20, 2018, 3 pages.
Machine Translation and Abstract of Chinese Publication No. CN202651351, Jan. 2, 2013, 8 pages.
Machine Translation and Abstract of Korean Publication No. KR20120013721, Feb. 15, 2012, 13 pages.
Foreign Communication From a Counterpart Application, Chinese Application No. 201480037112.2, Chinese Office Action dated Mar. 6, 2018, 6 pages.

* cited by examiner

COMPOSITE RIGHT/LEFT-HANDED TRANSMISSION LINE ANTENNA

CROSS-REFERENCE TO RELATED APPLICATIONS

This application is a national stage of international patent application number PCT/CN2014/085835 filed on Sep. 3, 2014, which is hereby incorporated by reference.

TECHNICAL FIELD

The present disclosure relates to the field of communications technologies, and more specifically, to a composite right/left-handed transmission line antenna.

BACKGROUND

A composite right/left-handed transmission line antenna may be used in a mobile terminal such as a mobile phone. An example structure of an existing common composite right/left-handed transmission line antenna is shown in FIG. 1, including a radiator and a matching circuit. The matching circuit is generally capacitive (a capacitor C2 is used to indicate a capacitive characteristic of the matching circuit) in an operating frequency band, and the matching circuit is connected to a feed-in point (a point a) of a transmission line.

Due to application of a fourth generation (4G) technology, an antenna with higher bandwidth is required, a current 4G mobile phone requires a dozen or even dozens of frequency bands. Therefore, a composite right/left-handed transmission line antenna with higher bandwidth is required.

SUMMARY

In view of this, an objective of embodiments of the present disclosure is to provide a composite right/left-handed transmission line antenna, so as to provide higher bandwidth.

To achieve the objective, the following technical solutions are provided in the embodiments of the present disclosure:

According to a first aspect of the embodiments of the present disclosure, a composite right/left-handed transmission line antenna is provided, including a first radiator, a second radiator, and a capacitive matching circuit, where: the first radiator is connected to the second radiator, and the connected first radiator and second radiator are of a ring shape; and the matching circuit is connected to a feed-in point of the first radiator or the second radiator.

With reference to the first aspect, in a first possible implementation manner, the composite right/left-handed transmission line antenna further includes a high frequency splitter.

With reference to the first possible implementation manner of the first aspect, in a second possible implementation manner, the high frequency splitter is connected to the first radiator or the second radiator.

With reference to the first aspect, the first possible implementation manner of the first aspect, or the second possible implementation manner of the first aspect, in a third possible implementation manner, a first end of the first radiator is connected to a first end of the second radiator, and a second end of the first radiator and a second end of the second radiator are used as a ground end.

With reference to the first aspect, the first possible implementation manner of the first aspect, the second possible implementation manner of the first aspect, or the third possible implementation manner of the first aspect, in a fourth possible implementation manner, the first radiator and the second radiator are of a same length.

With reference to the first aspect, the first possible implementation manner of the first aspect, the second possible implementation manner of the first aspect, the third possible implementation manner of the first aspect, or the fourth possible implementation manner of the first aspect, or a fifth possible implementation manner of the first aspect, in a fifth possible implementation manner, the matching circuit includes at least one of a series combination of an inductor and a capacitor or a parallel combination of an inductor and a capacitor.

With reference to the first aspect, the first possible implementation manner of the first aspect, the second possible implementation manner of the first aspect, the third possible implementation manner of the first aspect, the fourth possible implementation manner of the first aspect, the fifth possible implementation manner of the first aspect, or the sixth possible implementation manner of the first aspect, in a seventh possible implementation manner, the first radiator or the second radiator is a part of a housing of a mobile terminal.

It can be learned that, compared with a common composite right/left-handed transmission line antenna, the composite right/left-handed transmission line antenna in the embodiments of the present disclosure is additionally provided with one radiator, and the two radiators form a ring antenna. Due to a larger radiation area of the ring antenna, bandwidth higher than that of the existing common composite right/left-handed transmission line antenna can be generated, and a bandwidth requirement of a 4G technology is met.

BRIEF DESCRIPTION OF DRAWINGS

To describe the technical solutions in the embodiments of the present disclosure more clearly, the following briefly describes the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly and completely describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
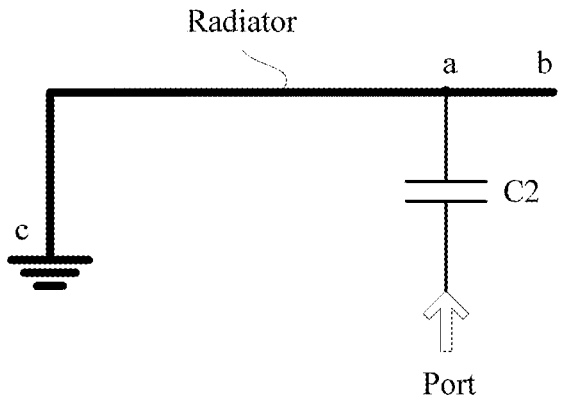
FIG. 1 is an example structural diagram of a common composite right/left-handed transmission line antenna.
Figure 2:
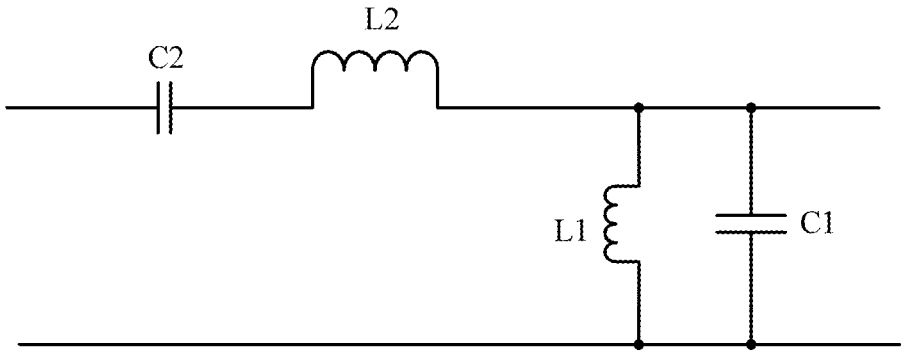
FIG. 2 is an equivalent circuit model diagram of the common composite right/left-handed transmission line antenna shown in FIG. 1.

For an equivalent circuit model corresponding to an existing common composite right/left-handed transmission line antenna shown in FIG. 1, refer to FIG. 2.

An equivalent inductor from a ground point (a point c) of a radiator to a point b in FIG. 1 may be represented by L2, an equivalent inductor from the ground point (the point c) of the radiator to a point a may be represented by L1, and an equivalent capacitor of the air may be represented by C1.

L1, L2, C1, and C2 form a right/left-handed mode in FIG. 2., L2 and C1 form an antenna resonance that fits a right-handed mode.

The embodiments of the present disclosure provide a composite right/left-handed transmission line antenna with higher bandwidth.

Figure 3:
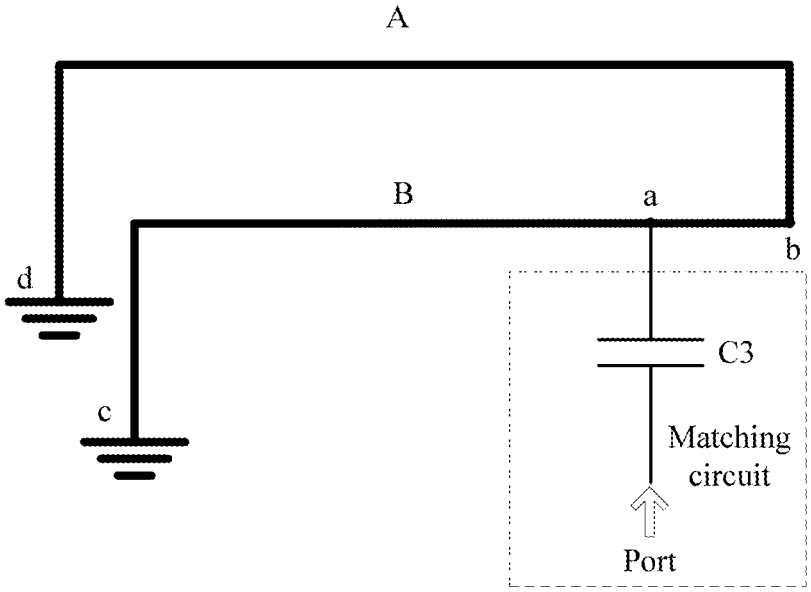
FIG. 3 is an example structural diagram of a composite right/left-handed transmission line antenna according to an embodiment of the present disclosure.

FIG. 3 shows an example structure of the foregoing composite right/left-handed transmission line antenna. The composite right/left-handed transmission line antenna may include a first radiator A, a second radiator B, and a capacitive matching circuit. Herein, being capacitive may specifically refer to generally being capacitive in an operating frequency band.

An equivalent capacitor of the matching circuit may be represented by C3.

The first radiator A is connected to the second radiator B, and the connected first radiator A and second radiator B are of a ring shape. That is, the first radiator A and the second radiator B form a ring antenna.

The matching circuit may be connected to a feed-in point of the first radiator A or the second radiator B (as shown in FIG. 3, the matching circuit is connected to a feed-in point a of the second radiator B).

More specifically, in all the foregoing embodiments, a first end of the first radiator A is connected to a first end of the second radiator, and a second end (d) of the first radiator A and a second end (c) of the second radiator B are used as a ground end. The end d to the end c forms a ring antenna.

In another embodiment of the present disclosure, the capacitive matching circuit may include a series combination of an inductor and a capacitor, or a parallel combination of an inductor and a capacitor, or include both a series combination of an inductor and a capacitor and a parallel combination of an inductor and a capacitor.

In another embodiment of the present disclosure, lengths of the first radiator A and the second radiator B that are in all the foregoing embodiments may be the same or may be different.

In FIG. 3, the ring antenna formed by the first radiator A and the second radiator B meets a rule of a right-handed transmission line model. C3 and an equivalent inductor of a parallel connection of the first radiator A and the second radiator B meet a rule of a left-handed transmission line model. For an equivalent circuit model corresponding to the composite right/left-handed transmission line antenna shown in FIG. 3, refer to FIG. 4.

It should be noted that, in FIG. 3, an equivalent inductor from a ground point (an end d) of the first radiator A to a point a may be represented by Lda, an equivalent inductor from the point a (a feed-in point) to a ground point (an end c) of the second radiator B may be represented by Lac, an equivalent inductor of a parallel connection of Ldac and Lac may be represented by L3, and an equivalent inductor of the two radiators (from the end d to the end c) in FIG. 3 may be represented by L4.

Figure 4:
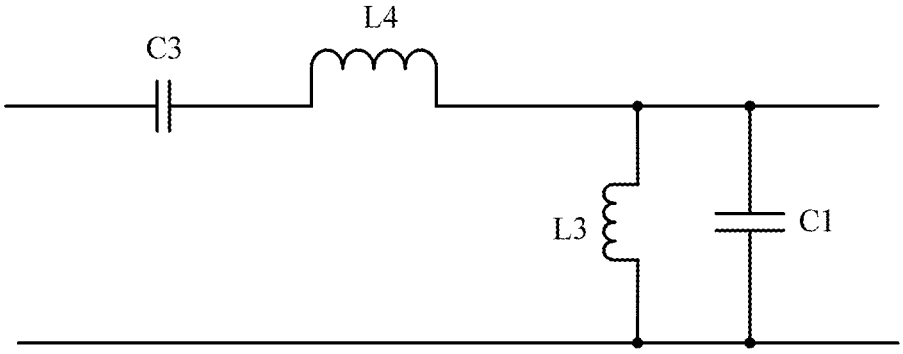
FIG. 4 is an equivalent circuit model diagram of the antenna shown in FIG. 3.

L4, L3, C1, and C3 form a right/left-handed mode in FIG. 4. L4 and C1 form an antenna resonance that fits a right-handed mode. In the right-handed mode, because the air dielectric constant is fixed, an operating wavelength in the right-handed mode is related only to dimensions from the end d to the end c, and the right-handed mode is a natural mode.

Figure 5:
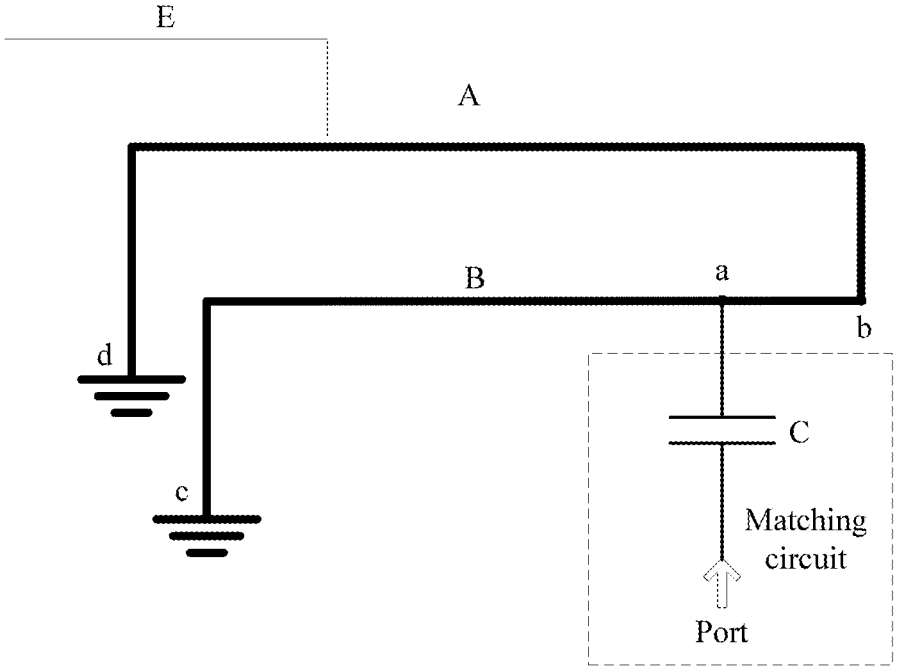
FIG. 5 is another example structural diagram of a composite right/left-handed transmission line antenna according to an embodiment of the present disclosure.

In another embodiment of the present disclosure, referring to FIG. 5, according to a need, the foregoing composite right/left-handed transmission line antenna may further include a high frequency splitter E.

More specifically, the high frequency splitter E may be connected to a first transmission line A or a second transmission line B.

It can be learned that a structure of the antenna provided in all the foregoing embodiments of the present disclosure also fits the right/left-handed mode. Compared with a common composite right/left-handed transmission line antenna, the composite right/left-handed transmission line antenna in the embodiments of the present disclosure is additionally provided with one radiator, and the two radiators form a ring antenna. Due to a larger radiation area of the ring antenna, bandwidth higher than that of the existing common composite right/left-handed transmission line antenna can be generated, and a bandwidth requirement of a 4G technology is met.

Figure 6:
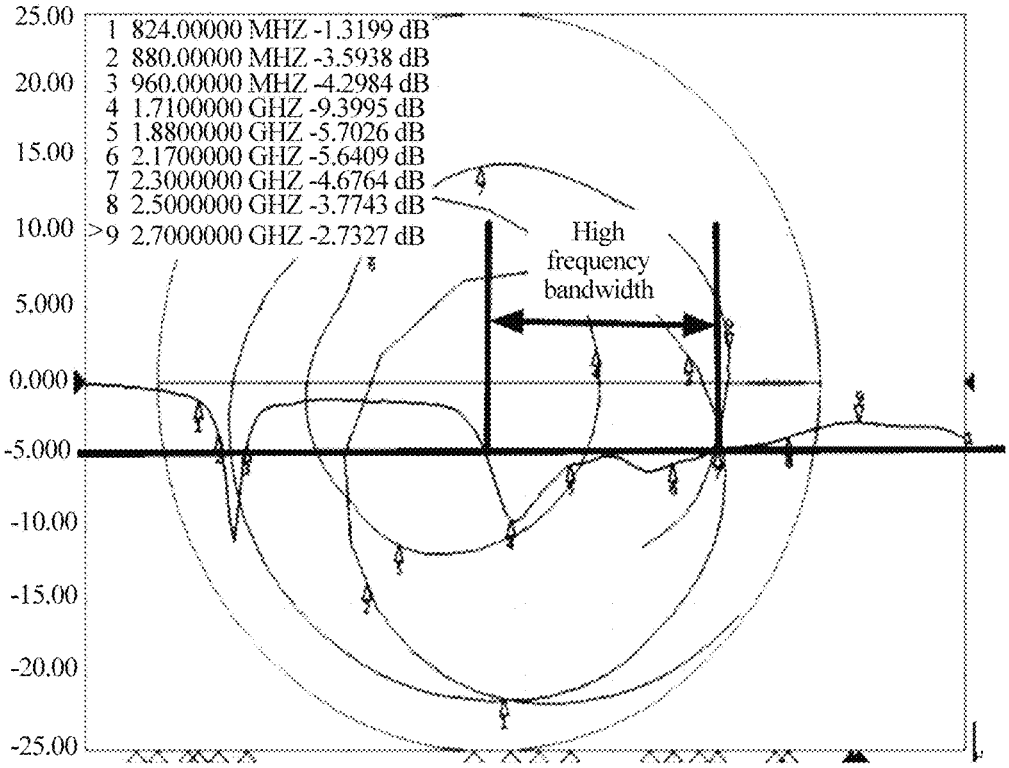
FIG. 6 is a diagram of a return loss of a common composite right/left-handed transmission line antenna.
Figure 7:
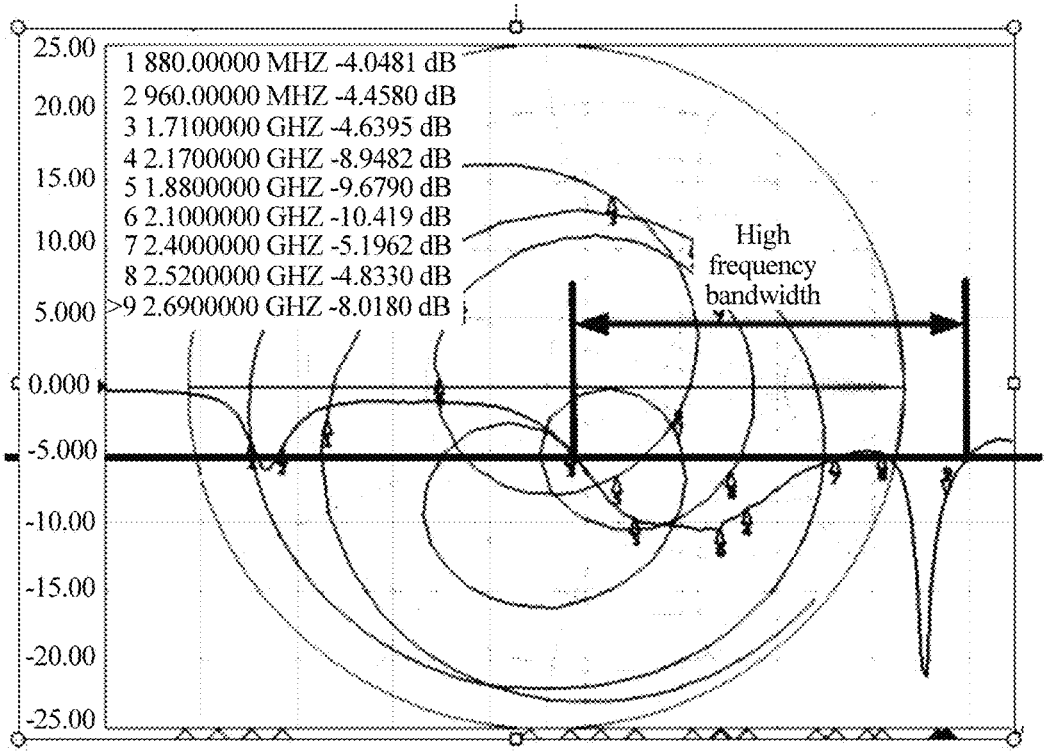
FIG. 7 is a diagram of a return loss of a composite right/left-handed transmission line antenna according to an embodiment of the present disclosure.

Referring to FIG. 6 and FIG. 7, FIG. 6 is a diagram of a return loss of an existing common composite right/left-handed transmission line antenna, and FIG. 7 is a return loss of a composite right/left-handed transmission line antenna according to an embodiment of the present disclosure. High-frequency bandwidth of the composite right/left-handed transmission line antenna provided in this embodiment of the present disclosure is higher than high-frequency bandwidth of the existing common composite right/left-handed transmission line antenna.

Figure 8:
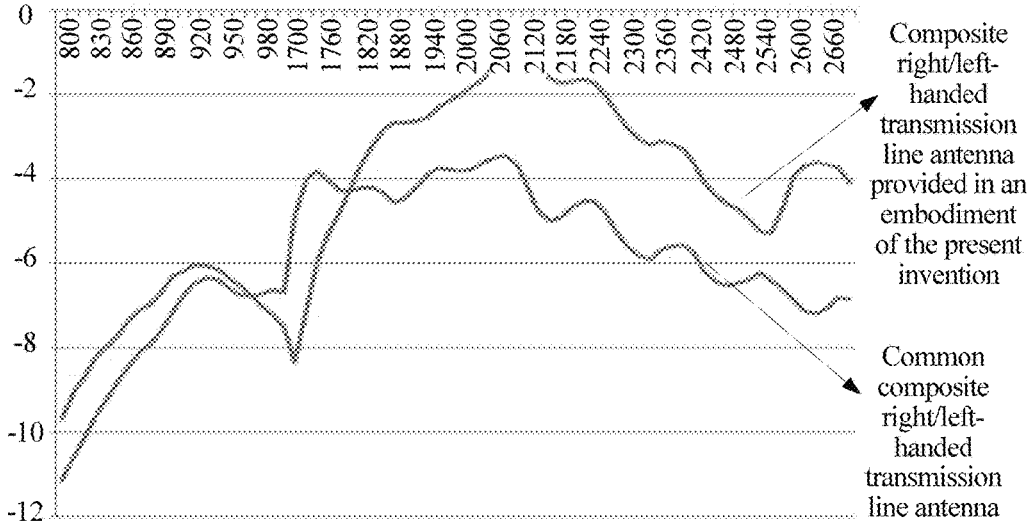
FIG. 8 is an antenna system efficiency comparison diagram according to an embodiment of the present disclosure.

In addition, referring to an antenna system efficiency comparison diagram shown in FIG. 8, in an available frequency band (880 megahertz (MHz) to 960 MHz, and 1760 MHz to 2690 MHz), system efficiency of the composite right/left-handed transmission line antenna provided in this embodiment of the present disclosure is basically higher than that of the existing common composite right/left-handed transmission line antenna.

It can be learned that the composite right/left-handed transmission line antenna provided in this embodiment of the present disclosure is superior to the common composite right/left-handed transmission line antenna, no matter in terms of bandwidth or in terms of antenna efficiency.

The foregoing composite right/left-handed transmission line antenna may be installed in various forms on a mobile terminal. For example, the first radiator A (or the second radiator B) may be a part of a housing (bezel) of the mobile terminal, and another part is located inside the housing and on the rear of the mobile terminal.

Figure 9:
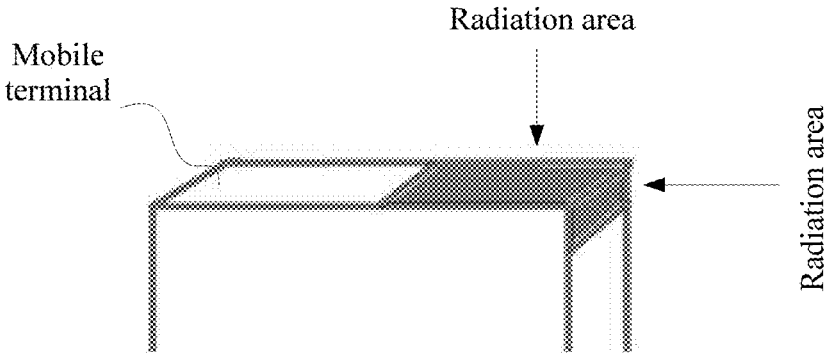
FIG. 9 is a three-dimensional diagram of an angle of a mobile terminal equipped with a common composite right/left-handed transmission line antenna.
Figure 10:
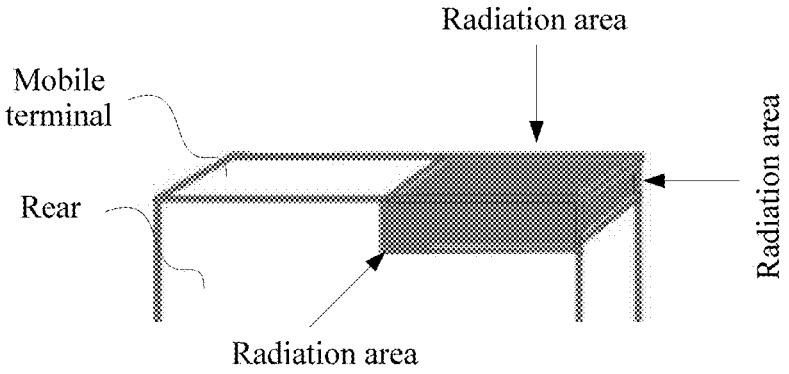
FIG. 10 is a three-dimensional diagram of an angle of a mobile terminal equipped with a composite right/left-handed transmission line antenna according to an embodiment of the present disclosure.

In this case, FIG. 9 and FIG. 10 are compared. FIG. 9 is a three-dimensional diagram of an angle of a mobile terminal equipped with a common composite right/left-handed transmission line antenna, and FIG. 10 is a three-dimensional diagram of an angle of a mobile terminal equipped with a composite right/left-handed transmission line antenna according to an embodiment of the present disclosure.

A black part in FIG. 9 represents a radiation area of the common composite right/left-handed transmission line antenna, and a black part in FIG. 10 represents a radiation area of the composite right/left-handed transmission line antenna provided in this embodiment of the present disclosure. It can be learned that, compared with FIG. 9, a radiation area is added to the rear of the mobile terminal in FIG. 10, which approximately doubles a total radiation area of the antenna, and a maximum radiation area is larger.

An additional head-hand test indicates that, a mobile terminal using the composite right/left-handed transmission line antenna according to this embodiment of the present disclosure has a better transmission effect and a longer communication distance. In addition, because the rear of the mobile terminal is a most effective radiation zone in actual use, the mobile terminal is not easy to get hot even after long-duration communication.

The embodiments in this specification are all described in a progressive manner, for same or similar parts in the embodiments, reference may be made to these embodiments, and each embodiment focuses on a difference from other embodiments.

It should be further noted that in this specification, relational terms such as first and second are only used to distinguish one entity or operation from another, and do not necessarily require or imply that any actual relationship or sequence exists between these entities or operations. In addition, the terms "include," "comprise," any other variant is intended to cover a non-exclusive inclusion, so that the composite right/left-handed transmission line antenna that includes a series of elements not only includes those elements, but also includes other elements that are not explicitly listed, or further includes elements inherent to the composite right/left-handed transmission line antenna. An element preceded by "includes a . . . " does not, without more constraints, preclude the existence of additional identical elements in the composite right/left-handed transmission line antenna that includes the element.

The embodiments provided are described to enable a person skilled in the art to implement or use the present disclosure. Various modifications to the embodiments are obvious to the person skilled in the art, and general principles defined in this specification may be implemented in other embodiments without departing from the spirit or scope of the present disclosure. Therefore, the present disclosure will not be limited to the embodiments described in this specification but extends to the widest scope that complies with the principles and novelty provided in this specification.

What is claimed is:

1. A composite right/left-handed transmission line antenna, comprising:

a first radiator;

a second radiator coupled to the first radiator, wherein the first radiator and second radiator together form a ring shape;

a feed-in point of the first radiator or the second radiator;

a matching circuit coupled to the feed-in point; and a high-frequency splitter coupled to the first radiator or the second radiator.

2. The composite right/left-handed transmission line antenna of claim 1, wherein a first end of the first radiator is connected to a second end of the second radiator.

3. The composite right/left-handed transmission line antenna of claim 2, wherein a third end of the first radiator and a fourth end of the second radiator are configured to be used as ground ends.

4. The composite right/left-handed transmission line antenna of claim 1, wherein the first radiator and the second radiator are of a same length.

5. The composite right/left-handed transmission line antenna of claim 1, wherein the matching circuit comprises:

a series combination of a first inductor and a first capacitor; and a parallel combination of a second inductor and a second capacitor.

6. The composite right/left-handed transmission line antenna of claim 1, wherein the matching circuit comprises a series combination of an inductor and a capacitor.

7. The composite right/left-handed transmission line antenna of claim 1, wherein the matching circuit comprises a parallel combination of an inductor and a capacitor.

8. The composite right/left-handed transmission line antenna of claim 1, wherein the first radiator is a part of a housing of a mobile terminal.

9. The composite right/left-handed transmission line antenna of claim 1, wherein the second radiator is a part of a housing of a mobile terminal.

10. The composite right/left-handed transmission line antenna of claim 1, wherein the matching circuit is capacitive.

11. A composite right/left-handed transmission line antenna, comprising:

a first radiator;

a second radiator coupled to the first radiator, wherein the first radiator and second radiator together form a ring shape;

a feed-in point of the first radiator; and a capacitive matching circuit coupled to the feed-in point.

12. The composite right/left-handed transmission line antenna of claim 11, further comprising a high-frequency splitter coupled to the first radiator or the second radiator.

13. A composite right/left-handed transmission line antenna, comprising:

a first radiator having a first end directly coupled to ground;

a second radiator having a second end coupled to a second end of the first radiator, wherein the first radiator and second radiator together form a ring shape, and wherein a first end of the second radiator is directly coupled to the ground;

a feed-in point of the first radiator or the second radiator; and a matching circuit coupled to the feed-in point.

14. The composite right/left-handed transmission line antenna of claim 13, further comprising a high-frequency splitter coupled to the first radiator or the second radiator.

* * * * *